United States Patent [19]

Degnan, Jr. et al.

[11] Patent Number: 4,853,104

[45] Date of Patent: Aug. 1, 1989

[54] PROCESS FOR CATALYTIC CONVERSION OF LUBE OIL BAS STOCKS

[75] Inventors: Thomas F. Degnan, Jr., Yardley, Pa.; Philip Varghese, Voorhees, N.J.

[73] Assignee: Mobil Oil Corporation, New York, N.Y.

[21] Appl. No.: 183,866

[22] Filed: Apr. 20, 1988

[51] Int. Cl.[4] ..... C10G 67/02; C10G 69/04

[52] U.S. Cl. ..... 208/61; 208/18; 208/58; 208/78; 208/96; 208/99

[58] Field of Search ..... 208/58, 61, 78, 80, 208/87, 88, 96, 97, 18, 113, 99

[56] References Cited

U.S. PATENT DOCUMENTS

| | | | |
|---|---|---|---|
| 2,868,716 | 1/1959 | Moyer | 208/87 |
| 2,895,903 | 7/1959 | Johnston | 208/36 |
| 2,902,443 | 9/1959 | Wadley | 208/87 |
| 3,159,567 | 12/1964 | Young | 208/87 |
| 3,193,489 | 7/1965 | Gemmell | 208/80 |
| 3,331,766 | 7/1967 | Young | 208/87 |
| 3,617,476 | 11/1971 | Woodle | 208/96 |
| 3,642,611 | 2/1972 | Robertson et al. | 208/87 |
| 3,650,943 | 3/1972 | Schuller | 208/60 |
| 3,652,448 | 3/1972 | Cummins | 208/87 |
| 3,654,137 | 4/1972 | Dober et al. | 208/87 |
| 3,660,273 | 5/1972 | Cummins | 208/96 |
| 3,696,023 | 10/1972 | Koch | 208/87 |
| 3,758,401 | 9/1973 | Bridgeford et al. | 208/78 |
| 3,758,628 | 9/1973 | Strickland et al. | 208/58 |
| 3,766,055 | 10/1973 | Cummins et al. | 208/96 |
| 3,781,196 | 12/1973 | Thompson | 208/18 |
| 3,790,470 | 2/1974 | Mead et al. | 208/58 |
| 3,923,636 | 12/1975 | Mead et al. | 208/58 |
| 3,929,617 | 12/1975 | Henry et al. | 208/18 |
| 4,181,598 | 1/1980 | Gillespie et al. | 208/87 |
| 4,229,282 | 10/1980 | Peters et al. | 208/87 |
| 4,661,238 | 4/1987 | Humbach et al. | 208/58 |

*Primary Examiner*—Anthony McFarlane

*Attorney, Agent, or Firm*—Alexander J. McKillop; Charles J. Speciale; Malcolm D. Keen

[57] ABSTRACT

Disclosed are methods for upgrading lube oil base stocks comprising the steps of hydrocracking such materials, preferably under relatively moderate conditions, and subsequently separating the hydrocracked materials to produce in an aromatic rich extract stream and an aromatics lean raffinate stream. The separation step is preferably achieved by solvent extraction of at least a portion of the hydrocracked material. The stream comprising the aromatic rich extract is then catalytically cracked under fluidized conditions to produce gasoline and other distillates. The aromatics lean raffinate stream is further processed by dewaxing and/or the like to produce relatively high volume metric yields of low viscosity lube oil having improved viscosity-temperature characteristics.

10 Claims, 1 Drawing Sheet

PROCESS FOR CATALYTIC CONVERSION OF LUBE OIL BAS STOCKS

The present invention relates to methods for the production of lube oils and gasoline. More particularly, this invention relates to processes for converting lube oil base stocks into more valuable products such as finished lube oils, gasoline and gasoline blending components, and distillates and distillate blending components.

In typical refinery operations, crude oil is initially distilled under atmospheric pressure into several fractions, including gasoline, naphtha, gas oil and other distillates, and residuum. Several alternative processing options exist for the atmospheric tower bottoms (ie., atmospheric residuum). The choice generally depends upon a large number of interrelated factors, including the desired mix of products from the refinery, product pricing and the nature and quality of available crude. The atmospheric residuum is sometimes passed directly to a deresining or deasphalting unit where deasphalted oil (DAO) is separated from the asphalt fraction. This type of operation is particularly appropriate when the crude is relatively high in asphaltenes and when maximum lube oil production is desired. The DAO is then further processed by various techniques to produce lube oils. In other cases, the atmospheric residuum is further fractionated in a vacuum distillation process where various additional products and/or intermediate streams such as vacuum gas oil (VGO), wax distillate, cylinder stock and vacuum resid are generally produced. This frequently occurs when the crude is of a relatively high quality and when maximum gasoline and distillate production is desired. In cases such as this, the VGO and/or the vacuum resid are converted in a fluid catalytic cracking (FCC) operation to gasolines, other distillates, coke and gaseous products, with gasolines and distillates generally being preferred.

In addition to the cases described above, refinery economics also frequently dictate that both lube oils and gasoline products be produced from the existing crude mix. In these cases, a variation or perhaps a combination of the above processing steps may be employed.

Many methods have been suggested for improving the quantity and/or quality of lubricating oils produced in petroleum refinery operations. For example, U.S. Pat. No. 3,660,273-Cummins is directed to methods of upgrading fractions such as deasphalted oil (DAO) to lighter lube oil fractions which have improved ultraviolet light stability. The process involves hydrocracking a lube oil feedstock and then subjecting the hydrocracked material to solvent refining. In the hydrocracking portion of the process described by Cummins, preferred reaction conditions include temperatures in the range of 750°to 800° F., pressures in the range of from about 1000 to about 2500 psig, and space velocities between about 0.3 and 1.5 v./hr./v. Hydrogen rates of about 3000 to 1000 scfb are also said to be preferred. Solvents such as furfural, nitrobenzene, dimethylformamide, liquid $SO_2$ and N-methyl-2-pyrrolidone are preferably used at dosages of 100 to 300% and temperatures between 120°and 180° F. The preferred solvent is N-methyl-2-pyrrolidone since this solvent is said to aid in the production of lube oils which are relatively insensitive to ultraviolet light. According to the Cummins reference, the lube oils produced in the solvent refining may be subject to dewaxing in order to reduce pour point. The Cummins reference contains no disclosure relating to the disposition of the extract from the solvent refining process.

U.S. Pat. No. 2,895,903-Johnston also relates to processes for producing lubricating oils, particularly oils having a high viscosity index. The methods of Johnston relate to the production of lubricating oils from heavy crude fractions or residual oils which are highly aromatic and/or naphthenic in character. The methods require low conversion cracking, preferably catalytically, of such materials at elevated cracking temperatures with the formation of lubricating oil components and highly carbonaceous products. The lubricating oil and the carbonaceous material are separated. Highly saturated components of the oil thus produced are separated from the highly aromatic components by selective extraction, the raffinate from said stream comprising the high quality lubricating oil. Johnston indicates that the low conversion cracking step of his invention may utilize thermal cracking, catalytic cracking or both; however catalytic decarbonization in dispersed phase catalytic cracking is specifically mentioned. Johnston suggests that in the case of riser type disperse phase catalytic cracking, the heaviest distillate fractions produced thereby are processed for the recovery of saturate lubricating oil components while the extracted aromatic components are blending with the remaining gas oil as a feedstock for catalytic cracking, or used as high boiling aromatic solvent, fuel oil cutter stock, and the like.

U.S. Pat. No. 3,617,476-Woody describes processing schemes whereby lubricating oil stocks are said to be converted in good yields into high quality lubricating oil. The Woody reference describes a process which consists of contacting a lubricating oil stock with hydrogenation catalyst under mild hydrogenation conditions. These conditions are said to include temperatures of between 570° F. and 800° F. and pressures between about 250 and 600 psig. The hydrogenated material is subsequently solvent extracted to produce an aromatic rich extract and an aromatic poor raffinate. The raffinate is subsequently dewaxed to produce high viscosity index lubricating oils. No disclosure regarding disposition of the extract stream is provided.

Several methods of converting heavy crude oil fractions to gasoline and distillates in modified FCC operations have also been suggested. For example, U.S. Pat. No. 3,642,611-Robertson et al suggests that high quality motor fuel and jet fuel may be obtained by first solvent extracting gas oil feedstocks to produce a paraffin rich raffinate and an aromatic rich extract. Although hydrocarbons boiling above about 500° F. are said to be included in the invention of Robertson et al, the preferred starting materials are said to be virgin atmospheric gas oils and cycle oils. The raffinate and extract streams are each then hydrocracked to produce jet fuel and motor fuel respectively. U.S. Pat. No. 3,654,137-Dober et al also relates to processes involving the solvent extraction of gas oils to produce an aromatics rich extract stream and an aromatics lean raffinate stream. Accordingly to the disclosure of Dober, both the raffinate and the extract streams are then further processed in an FCC unit in a non hydrogen atmosphere. A similar process is described in U.S. Pat. No. 3,696,023-Koch. U.S. Pat. No. 3,193,489-Gemmell also relates to processes for producing distillate fuels. In particular, relatively heavy hydrocarbon fluids such as opped crudes, pitch and other hydrocarbon fluids containing relatively large amounts of metal contaminates or coke are introduced into a first catalytic reaction zone whereupon the hydrocarbon effluent therefrom is fractionated into cracked products and cycle oil. In a similar manner, gas oil and other distillates low in metal oxide content are introduced into a second catalytic cracking zone to produce a hydrocarbon effluent which is fractionated into cracked products and cycle oil. The cycle oil streams from the first and second catalytic cracking zones are subject to a solvent extraction operation for separation of aromatic and paraffinic hydrocarbons. According to the teachings of Gemmell, two raffinate streams and an extract stream are produced in the solvent extraction process. The intermediate raffinate stream, which is said to be rich in intermediate aromatic hydrocarbon, is subject to a catalytic cracking operation conducted at temperatures in the range of 870°to 900° F. and at conversions of about 30 to 40%. The light raffinate is subject to severe catalytic cracking conditions, i.e., temperatures of about 905°to 930° F. and conversions of about 50 to 70%. With regard to the extract stream, Gemmell reveals only that the stream is introduced into a $SO_2$ recovery zone wherein the solvent is separated from the aromatic extract oil.

The present invention relates to methods of processing atmospheric residuum or fractions thereof to improve the yield of gasoline and other distillate products from fluid catalytic cracking operations. The methods also usually include processing steps which enhance the quality and quantity of lubricating oils produced from the atmospheric residuum or its fractions. For the purpose of convenience, the term "lube oil base stock" is used herein to refer to refinery hydrocarbon streams, and their fractions, which are typically capable of being upgraded to lubricating oils. Heavier-than-gasoline feedstocks are generally included within the scope of this term. As the term is used herein, heavier-than-gasoline feedstocks generally mean hydrocarbons having an initial boiling point above about 400° F. Accordingly, lube oil base stocks include atmospheric residuum and its fractions, such as deasphalted oils, vacuum gas oils, wax distillate, vacuum residuum, and the like.

It is an object of the present invention to maximize the yield of desirable products from lube oil base stocks.

It is a further object of the present invention to provide processes which contribute to the quantity and quality of lube oils, gasolines, and other distillates in a refinery operation.

It is a still further object of the present invention to provide a solvent extract stream which, when introduced into a fluid catalytic cracking operation, increases the production of desirable products produced thereby.

The present invention relates generally to methods for upgrading lube oil base stocks comprising the steps of hydrocracking such materials, preferably under relatively moderate conditions, and subsequently separating, preferably by solvent extraction, the hydrocracked materials to produce an aromatics rich extract stream and an aromatics lean raffinate stream. In certain embodiments, a stream comprising the aromatics rich extract is catalytically cracked under fluidized conditions to produce gasoline and other distillates. The aromatics lean raffinate stream may also be further processed by dewaxing and/or the like to produce relatively high volumetric yields of low viscosity lube oils having improved viscosity-temperature characteristics. In particular, the lube oils produced by the methods of the present invention preferably have a 212° F. Saybolt Universal viscosity (SUS @ 212°F.) of less than about 200 and a viscosity index of greater than about 90. Moreover, the processes of the present invention preferably produce lube oil in sufficient quantity to yield a lube oil:-lube oil base stock ratio of at least about 1:5 on a volume basis.

The methods of the present invention generally require hydrocracking, and preferably mildly hydrocracking, a lube oil base stock to produce a hydrocracked stream. As is well understood by those skilled in the art, hydrocracking generally comprises the conversion in the presence of hydrogen of relatively high molecular weight hydrocarbons to relatively low molecular weight hydrocarbons, usually paraffins and olefins. The extent of this reaction is functionally related to many parameters, including reaction conditions such as temperature, pressure and space velocity. In many standard hydrocracking operations, reaction conditions are chosen so as to result in "severe" hydrocracking. As the term is used herein, severe hydrocracking is used in a relative sense to refer to those reaction conditions which result in relatively extensive hydrogen saturation of the feedstock. High temperatures and pressures, and relatively long space velocities are usually associated with severe hydrocracking. In normal refinery operations, the purpose of hydrocracking is to saturate and crack aromatic and naphthenic hydrocarbons to produce paraffins. Thus, high pressures, temperatures, and relatively long space velocities were heretofore generally utilized in order to maximize conversion of the aromatics and naphthenics in the feed. According to a preferred embodiment of the present invention, however the lube oil base stock is hydrocracked under moderate conditions. As the terms are used herein, "mild hydrocracking" and "moderate hydrocracking" generally refer to hydrocracking reactions in which the hydrocracked material comprises at least about 10 weight percent aromatic hydrocarbons. As is readily understood by those skilled in the art, the exact hydrocracking conditions which will produce such a percentage of aromatics will vary greatly depending upon, among other factors, the characteristics of the lube oil base stock being processed. Applicant has found that moderate hydrocracking is preferably achieved by assuring relatively moderate pressures in the reactor inlet. Thus, reactor inlet pressures of from about 400 psig to about 2000 psig are generally preferred, with pressures of from about 600 to about 1500 psig being even more preferred.

The reaction temperatures of the hydrocracking step and the space velocity of the lube oil base stock in the reactor also affect the extent of hydrogen saturation. Accordingly, the hydrocracking severity may be adjusted by manipulating the temperature and/or space velocity. Hydrocracking reaction temperatures according to the present invention preferably range from about 500° F. to about 900° F., with temperatures from about 700°to about 850° F. being even more preferred. Space velocities according to the present invention preferably range from about 0.1 v./h./v./ to about 1.0 v./h./v.

As previously indicated, the feedstocks which are subject to the hydrocracking step of the present invention generally comprise lube oil base stocks. Although the processes of the present invention are generally applicable to all lube oil base stocks, applicant has found that the use of virgin lube oil base stocks is preferred since these materials contain the most advantageous mix of paraffinic and aromatic constituents. As the term is used herein, a virgin lube oil base stock means a lube oil base stock which has not previously undergone cracking operations, either thermal or catalytic. It should be noted, however, that this term in no way excludes lube oil base stocks which may have been exposed to the relatively minor cracking conditions which sometimes occur in atmospheric or vacuum tower bottoms. Applicants have found that virgin lube oil base stocks such as DAO and vacuum gas oil are especially preferred feedstocks for the hydrocracking step of the present invention.

It is contemplated that the hydrocracking step of the present invention will be adaptable for use with all generally accepted hydrocracking catalysts. As is known to those skilled in the art, catalysts employed in hydrocracking operations generally comprise dual function catalysts. Catalysts of this type are generally preferable since they provide high surface area for cracking and numerous hydrogenation/dehydrogenation sites. Thus, the catalysts preferably comprise transition metals, more preferably metals selected from Group VIII of the periodic table, and even more preferably form the group consisting of cobalt, nickel, molybdenum, tungsten, vanadium, palladium, platinum, and oxides of these. Zeolites and/or silica alumina generally provide the high surface area acidic component of the dual function catalyst.

Accordingly to the methods of the present invention, the effluent from the hydrocracking operation, sometimes also referred to as the hydrocrackate, is further processed by solvent extraction to produce an aromatic rich extract stream and an aromatics lean raffinate stream. The hydrocracked materials may be processed directly by solvent extraction. According to certain preferred embodiments of the present invention, however, the hydrocrackate is first processed by stripping or flash distillation to remove lighter components such as naphtha and fuel gas. The material after such processing may then be further distilled to remove hydrocrackate components that boil below about 900° F. In some embodiments, the further distillation step removes only those hydrocrackate components boiling below about 700° F. The hydrocrackate with such relatively low boiling components removed is then preferably solvent extracted according to the methods of the present invention.

The details of solvent extraction extraction processes are well known to those skilled in the art and accordingly are not discussed at length in the present application. A thorough discussion of solvent extraction is provided in Chapter 11 of Nelson, "Petroleum Refinery Engineering", McGraw-Hill, Fourth Edition, 1958, which is incorporated herein by reference. For purposes of the present application it is sufficient to note that solvent extraction generally consists of contacting, usually in a counter-current fashion, the material to be fractionated with a solvent which has a greater affinity for one of the fractions than the other. Many solvents are available for separating aromatic fractions from paraffinic fractions and it is contemplated that the use of all such solvents is within the scope of the present invention. Although it is believed that solvents such as phenol, furfural, ethylene glycol, liquid sulfur dioxide, dimethyl sulfoxide, dimethylformamide, ethylene glycol, n-methyl pyrrolidone and n-vinyl pyrrolidone are all acceptable for use as solvents in the solvent extraction step of the present invention, it has been found that furfural, phenol and n-methyl pyrrolidone are preferred.

According to certain preferred embodiments of the present invention, the concentration of aromatic components in the extract from the solvent extraction step is preferably greater than about 10 weight percent on a solvent free basis. It will be appreciated by those skilled in the art that the aromatic content of the solvent extract is a function of many variables, including the parameters of the solvent extraction process and the reaction conditions in the hydrocracking operation. Thus, while it is preferred that the hydrocrackate have an aromatics concentration of greater than about 20 weight percent, an aromatics concentration of more than about 30 weight percent of the hydrocrackate is even more preferred since this will permit greater flexibility in the solvent extraction step. As the term is used herein, "weight percent aromatics" means the weight percent of hydrocarbons containing aromatic rings, on a solvent free basis. The aromatics content is typically determined using the silica gel separation method.

According to one important aspect of certain embodiments of the present invention, the aromatic lean raffinate stream produced upon solvent extraction of the hydrocracked lube oil base stocks is further processed to produce lubricating oils. Applicant has found that the raffinate produced according to the methods of the present invention is exceptionally well suited for the production of lubricating oils. In particular, applicant has found that further processing of the aromatic lean raffinate produces high yields of lubricating oils of exceptionally high quality. For example, lubricating oils produced according to methods of the present invention generally have an improved viscosity index (VI). Further processing of the raffinate stream preferably comprises dewaxing of the raffinate by any of the well known dewaxing processes such as, for example, "pressing and sweating", centrifugation, solvent dewaxing and catalytic dewaxing using shape selective zeolites. The details of each of these dewaxing operations, and others, are well known in the art and accordingly are not discussed at length in the present application. A thorough discussion of dewaxing operations is provided in chapter 12 of Nelson, Petroleum Refinery Engineering, McGraw-Hill, 1958, which is incorporated herein by reference.

A further preferred method step of the present invention comprises catalytically cracking a hydrocarbon stream comprising the extract produced during the solvent extraction step of the present invention. Although all forms and methods of catalytic cracking are within the scope of the present invention, fluidized catalytic cracking (FCC) is preferred, with disperse phase FCC type operations being even more preferred. In one preferred practice of the present invention, the extract is cracked concurrently with other FCC feedstocks. Many mechanisms for achieving concurrent catalytic cracking of the extract and other FCC feedstocks are possible and all such methods are within the scope of the present invention. For example, the extract may be initially blended with a standard FCC feedstocks such as VGO and the blend then passed to an FCC unit where the extract and VGO are cracked concurrently. Although all feedstock blends containing the extract of the present invention are within the scope thereof, applicants have found that the extract is preferably contained in the blend in an amount less than about 50 percent of the blend on a weight basis, and even more preferably less than about 25 percent. In another example, the extract and another FCC feedstock are introduced separately, at either the same or different locations, into one or more risers in an FCC unit. As the terms are used herein, "other FCC feedstock" and "standard FCC feedstock" mean all those hydrocarbon feedstocks capable of being processed in an FCC operation. Standard FCC feedstocks typically include straight run gas oil, vacuum gas oil, other vacuum distillates, other atmospheric distillates, atmospheric residuum, vacuum residuum and cycle oils and fractions of these. Applicant has found that catalytic cracking of the extract produced according to the methods of the present invention, especially when cracked concurrently with standard FCC feedstocks, provides an FCC product slate of higher yield and quality than prior processing schemes. All catalytic cracking operations are within the scope of the present invention. The techniques of catalytically cracking hydrocarbon materials are well known to those skilled in the art and accordingly are not discussed in detail in the present application. However, catalytic cracking operations are described in detail in Chapter 21 of Nelson, "Petroleum Refinery Engineering", McGraw-Hill, 1958, which is incorporated herein by reference.

SPECIFIC EMBODIMENTS

Figure 1:
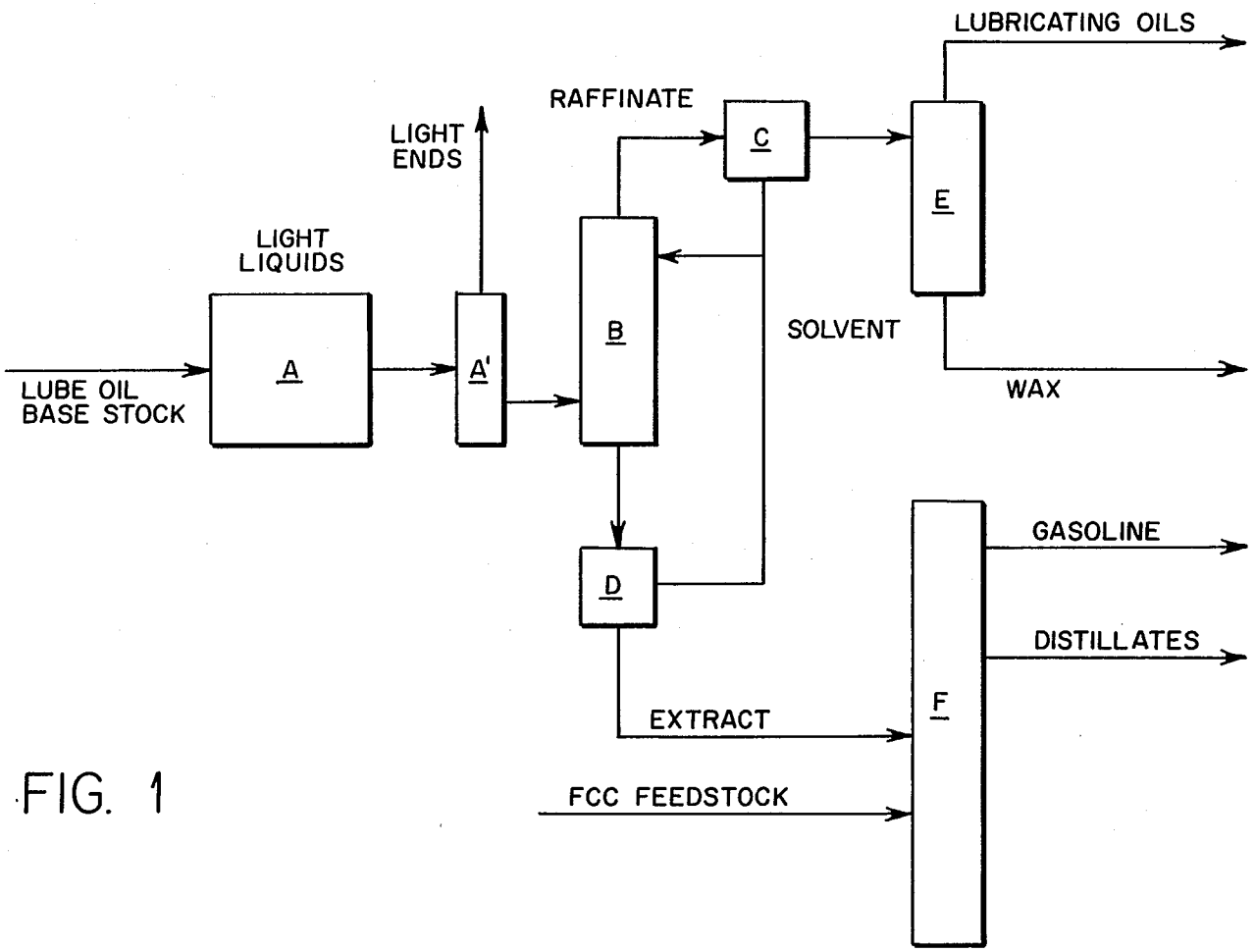
FIG. 1 is a simplified flow sheet of a process according to the present invention.

One specific processing scheme for carrying out the method steps of the present invention is depicted in block diagram form in FIG. 1. The steps depicted by FIG. 1 represent a preferred operating system which contributes to improvements in the yield and quality of both lubricating oils and the FCC products. In particular, lube oil base stock is introduced into a hydrocracking unit A where it is preferably hydrocracked under mild or moderate conditions. The hydrocrackate is then passed to flash distillation unit A' where lighter ends such as naphtha, fuel gas and other light liquids are removed. The hydrocrackate is then passed to a solvent extraction step B whereupon it is preferably contacted in counter current fashion with a solvent such as furfural. The overhead product from the solvent extraction unit is a relatively aromatic lean raffinate stream and the bottoms product is a relatively aromatic rich extract stream. Both the raffinate and the extract are treated by solvent recovery operations C and D whereupon the solvent is removed to obtain a substantially solvent free extract and a substantially solvent free raffinate. The recovered solvent is generally recycled to the solvent extraction unit for further use. The solvent free raffinate is then further processed in a dewaxing operation E where high quality lubricating oils of acceptable pour point are prepared by are separated or converting the wax components. The solvent free extract is further processed by concurrent cracking with an FCC feedstock in FCC unit F.

In order to illustrate the yield and quality benefits of the present invention, several tests were conducted utilizing several processing schemes, including processing schemes as depicted in FIG. 1, and variations thereof. The lube oil base stock used in these tests consisted of an Arab light raw distillate (ALRD) having the properties listed in Table 1 below.

TABLE 1

| Arab Light Raw Distillate (ALRD) | |
|---|---|
| API | 19.8 |
| Hydrogen, weight % | 12.2 |
| Sulfur, weight % | 2.61 |
| Nitrogen, ppm | 930 |
| Basic Nitrogen, ppm | 294 |
| Pour Point, °F. | 115 |
| Aromatics, weight % (silica gel) | 61 |
| D2887 Distillation, weight % | |
| IBP, °F. | 736 |
| 5 | 831 |
| 10 | 865 |
| 20 | 897 |
| 30 | 918 |
| 40 | 985 |
| 50 | 953 |
| 60 | 971 |
| 70 | 990 |

The FCC feedstock consisted of Joliet Sour Gas Oil (JSGO) having the properties indicated in Table 2 below.

TABLE 2

| Joliet Sour Gas Oil (JSGO) | |
|---|---|
| Carbon, weight % | 87.73 |
| Hydrogen, weight % | 12.44 |
| Sulfur, weight % | 2.34 |
| Density at 70° C., g/cc | 0.8849 |
| CCR by MCRT, weight % | 0.22 |
| H/C atomic | 1.70 |
| Distillation, weight. % | |
| IBP, °F. | 432 |
| 5 | 569 |
| 10 | 620 |
| 20 | 678 |
| 30 | 717 |
| 40 | 753 |
| 50 | 788 |
| 60 | 823 |
| 70 | 860 |
| 80 | 901 |
| 90 | 948 |

Several tests utilizing the feedstocks described in Tables 1 and 2 were conducted to illustrate the advantages of the present invention. These tests are described in the examples which follow. The glossary below is provided to aid understanding the examples which follow.

1. CONVERSION Unless otherwise indicated, the term "conversion" is defined as follows:

Conversion = 420° F.$^-$ + Coke where

420° F.$^-$ = Fraction of FCC product boiling below 420 ° F., weight %

Coke = Coke in FCC Product, weight %

When used in relation to the 650° F.$^-$ fraction, conversion is defined as follows:

Conversion = P650° F.$^-$ − F650° F.$^-$ + Coke where

F650° F.$^-$ = Fraction of the FCC feed boiling below 650° F., weight %

P650° F$^-$ = Fraction of the FCC product boiling below 650° F., weight %

2. CRACKABILITY $$\text{Crackability} = \frac{\text{Conversion}}{100 - \text{conversion}}$$

3. PRODUCT SELECTIVITY

PRODUCT SELECTIVITY = Component Yield/(F650° F.$^+$-P650° F.$^+$)

where

Component Yield = Amount of the particular

-continued

| | |
|---|---|
| | component in the FCC Product, weight % |
| 4. INCREMENTAL YIELD Incremental yield represents the contribution of the extract portion of the JSGO/extract blends decribed hereinafter to the overall product yield slate resulting from fluid catalytic cracking of those blends, proper account being made of the amount of each component in the blend | |

EXAMPLE 1

100 cubic centimeters of the ALRD described in Table 1 were subject to solvent extraction in a single stage furfural extraction unit without prior hydrocracking. The unit was operated with 1000 vol % solvent dosage at 107° F. After solvent recovery, 72 cubic centimeters of waxy raffinate and 28 cubic centimeters of extract were produced. The extract was analyzed and found to have the properties described in Table 3. The waxy raffinate was further processed in a methyl ethyl ketone (MEK) dewaxing unit to a 30° F. pour point. Forty (40) cubic centimeters of a lubricating oil having a viscosity index of 79 and a viscosity of 930 Saybolt Universal Seconds at 212° F. were recovered from the dewaxing operation.

TABLE 3

| | Unhydrocracked Extract |
|---|---|
| Carbon, Wt. % | 84.81 |
| Hydrogen, Wt. % | 9.57 |
| Sulfur, Wt. % | 4.80 |
| Basic Nitrogen, ppm | 558 |
| Density at 70° C., g/cc | 0.9968 |
| CCR By MCRT, Wt. % | 3.50 |
| H/C Atomic | 1.35 |
| Distillation, Wt. % | |
| IBP, °F. | 728 |
| 5 | 805 |
| 10 | 838 |
| 20 | 875 |
| 30 | 897 |
| 40 | 915 |
| 50 | 931 |
| 60 | 948 |
| 70 | 966 |
| 80 | 986 |
| 90 | 1014 |

EXAMPLE 2

100 cubic centimeters of the ALRD described in Table 1 were mildly hydrocracked as follows:

Reactor Pressure, psig:1750

Liquid hourly space velocity (LHSV):1

Hydrogen consumption, liters/cc:0.11

The hydrocracking catalyst was a dual function catalyst comprising a Ni-W-silica alumina catalyst (hereinafter referred to as "Cat1") and a Ni-Mo steamed USY catalyst (hereinafter referred to as "Cat2"). The hydrocracking catalysts had a Cat1:Cat2 volume ratio of about 1:1. The hydrocracking catalyst had been on stream for approximately 2 months before being utilized in these tests. The hydrocrackate was distilled to remove components boiling below about 650° F. After removal of the light ends, ninety eight (98) cubic centimeters of 650° F.+ hydrocrackate were then passed to a solvent extraction step operated under conditions essentially identical to those described in Example 1. Seventy eight (78) cubic centimeters of waxy raffinate and 20 cubic centimeters of extract were produced. The extract was analyzed and found to have the properties described in Table 4. After solvent recovery, the waxy raffinate was dewaxed under conditions essentially identical to those described in Example 1. 52 cubic centimeters of a lubricating oil having a viscosity index of 106 and a viscosity of 310 Saybolt Universal Seconds at 212° F. were recovered.

TABLE 4

| | Hydrocracked Extract |
|---|---|
| Carbon, Wt. % | 87.53 |
| Hydrogen, Wt. % | 10.60 |
| Sulfur, Wt. % | 1.81 |
| Basic Nitrogen, ppm | 153 |
| Density at 70° C., g/cc | 0.9525 |
| CCR By MCRT, Wt. % | 0.62 |
| H/C Atomic | 1.45 |
| Distillation, Wt. % | |
| IBP, °F. | 643 |
| 5 | 706 |
| 10 | 742 |
| 20 | 794 |
| 30 | 831 |
| 40 | 861 |
| 50 | 886 |
| 60 | 908 |
| 70 | 929 |
| 80 | 955 |
| 90 | 1011 |

It is apparent from a comparison of Examples 1 and 2 that the methods of the present invention produce lubricating oils of higher quality and in greater volumetric quantity than simple extraction techniques alone. In particular, the volumetric yield of lubricating oil increased by about 30 relative percent and viscosity index increased by about 27 numbers.

EXAMPLE 3

The Joliet Sour Gas Oil described in Table 2 was cracked in a disperse phase catalytic cracking operation under three sets of test conditions. Table 5 below describes the properties of the FCC catalyst used in the testing apparatus. Table 6 describes the operating parameters of each of the runs and the products produced thereby.

TABLE 5

| FCC Catalyst Properties | |
|---|---|
| Ash, 1000° C. | 97.25 |
| Packed Density g/cc | 0.96 |
| Loose Density, g/cc | 0.87 |
| Real Density, g/cc | 2.78 |
| Particle Density, g/cc | 1.37 |
| Pore Volume, cc/2g | 0.37 |
| Surface Area, $m^2/g$ | 113.0 |
| Carbon on catalyst, wt % | 0.17 |
| Alumina, wt % | 43.2 |
| Silica, wt % | 53.0 |
| Total Rare Earths, wt % | 2.95 |
| REY, wt % by X-Ray | 14.90 |
| Nickel, ppm | 470 |
| Vanadium, ppm | 1460 |
| Antimony, ppm | 29 |
| Iron, ppm | 5 |
| Copper, ppm | 80 |
| Particle Size Distribution | |
| 0 to 20 micron, wt % | 0.0 |
| 20 to 40 micron, wt % | 7.1 |
| 40 to 60 micron, wt % | 35.8 |
| 60 to 80 micron, wt % | 32.1 |
| 80 *microns, wt %* | 25.0 |

TABLE 6

| Example 3 Operating Conditions and Product Yields | | | |
|---|---|---|---|
| Run No. | 1 | 2 | 3 |
| Riser Top Temperature, °C. | 510 | 510 | 510 |
| Cat/Oil | 3.5 | 4.5 | 6.0 |
| WHSV, $HR^{-1}$ | 3.0 | 2.37 | 1.73 |
| No. of Cycles | 7 | 9 | 12 |
| Mass Balance, % Closure | 95.7 | 95.4 | 92.1 |
| Product Analysis. Wt. % | | | |
| $C_1$ | 0.48 | 0.55 | 0.81 |
| $C_2 + C_2=$ | 1.97 | 1.77 | 2.94 |
| $C_3$ | 0.83 | 1.00 | 1.52 |
| $C_3=$ | 4.57 | 4.72 | 6.75 |
| $iC_4$ | 1.81 | 2.42 | 3.22 |
| $nC_4$ | 0.25 | 0.45 | 0.51 |
| $C_4$='s | 2.13 | 3.11 | 3.17 |
| $C_5$–330° F. | 34.27 | 38.50 | 37.65 |
| 330°–420° | 11.69 | 11.20 | 10.32 |
| 420°–650° | 26.19 | 22.81 | 20.60 |
| 650°–850° | 11.58 | 8.95 | 7.06 |
| 850+ | 1.38 | 1.03 | 0.72 |
| % Coke | 2.85 | 3.49 | 4.73 |
| Product Selectivities | | | |
| Dry Gas | 2.98 | 2.74 | 4.30 |
| $C_4$— | 14.66 | 16.54 | 21.67 |
| $C_5$ to 330° F. | 41.72 | 45.74 | 43.12 |
| $C_5$ to 420° F. | 55.95 | 58.96 | 54.94 |
| 420 to 650° F. | 25.91 | 20.38 | 17.98 |
| Coke | 3.47 | 4.11 | 5.40 |
| Conversion and Crackability | | | |
| Conversion to 650° F.$^-$ | 82.14 | 84.77 | 87.31 |
| Conversion to 420° F.$^-$ | 60.85 | 66.86 | 71.61 |
| Conversion to 330° F.$^-$ | 49.16 | 55.66 | 61.29 |
| Crackability (based on 650° F.$^-$) | 1.55 | 2.01 | 2.52 |

EXAMPLE 4

The Joliet sour gas oil described in Table 2 and the extract produced by the procedure described in Example 1 were blended to produce a mixture having an extract:gas oil ratio of about 1:4 on a weight basis. The blend was analyzed and found to have the properties described in Table 7A.

TABLE 7A

| | JSGO Plus Unhydrocracked Extract |
|---|---|
| Carbon, Wt. % | 87.12 |
| Hydrogen, Wt. % | 11.45 |
| Sulfur, Wt. % | 2.83 |
| Basic Nitrogen, ppm | 374 |
| Density at 70° C., g/cc | 0.9056 |
| CCR By MCRT, Wt. % | 0.594 |
| H/C Atomic | 1.58 |
| Distillation, Wt. % | |
| IBP, °F. | 490 |
| 5 | 618 |
| 10 | 665 |
| 20 | 717 |
| 30 | 756 |
| 40 | 787 |
| 50 | 820 |
| 60 | 848 |
| 70 | 887 |
| 80 | 925 |
| 90 | 969 |

A comparison of Tables 7A and Table 2 indicates that combining the unhydrocracked extract and the JSGO produces a blend having properties which are generally less desirable than those possessed by the JSGO alone. For example, the blended material has a substantially reduced hydrogen content (i.e., 11.45 vs. 12.44 wt. %) and a substantially increased basic nitrogen (374 ppm vs. 321 ppm). The extract/JSGO blend was then introduced into the same FCC unit used to produce the results reported in Example 3 and catalytically cracked under essentially the same conditions described therein. An analysis of the product produced during these test runs is described in Table 7B below.

TABLE 7B

| Example 4 Operating Conditions and Product Yields | | | |
|---|---|---|---|
| Run No. | 4 | 5 | 6 |
| Temperature, °C. | 510 | 510 | 510 |
| Cat/Oil | 3.5 | 4.5 | 6.0 |
| WHSV, $HR^{-1}$ | 2.9 | 2.3 | 1.7 |
| No. of Cycles | 7 | 9 | 12 |
| Mass Balance, % Closure | 99.3 | 95.2 | 97.9 |
| Product Analysis. Wt. % | | | |
| $C_1$ | 0.39 | 0.57 | 0.81 |
| $C_2 + C_2=$ | 1.47 | 1.89 | 2.64 |
| $C^3$ | 0.74 | 0.72 | 1.37 |
| $C_3=$ | 3.07 | 3.45 | 5.75 |
| $iC_4$ | 1.62 | 1.88 | 2.74 |
| $nC_4$ | 0.27 | 0.32 | 0.55 |
| $C_4$='s | 1.91 | 2.84 | 3.34 |
| $C_5$–330° F. | 24.17 | 28.23 | 29.52 |
| 330°–420° | 15.32 | 14.49 | 13.26 |
| 420°–650° | 29.51 | 28.22 | 24.32 |
| 650°–850° | 14.17 | 10.97 | 8.99 |
| 850+ | 3.03 | 1.79 | 1.24 |
| % Coke | 4.33 | 4.63 | 5.47 |
| Product Selectivities | | | |
| Dry Gas | 2.38 | 2.97 | 4.05 |
| $C_4$— | 12.10 | 14.11 | 20.18 |
| $C_5$ to 330° F. | 30.88 | 34.13 | 34.62 |
| $C_5$ to 420° F. | 50.45 | 51.64 | 50.18 |
| 420 to 650° F. | 31.92 | 28.65 | 23.22 |
| Coke | 5.53 | 5.59 | 6.41 |
| Conversion to 650° F.— | 78.28 | 82.72 | 85.25 |
| Conversion to 420° F.— | 53.29 | 59.02 | 65.45 |
| Conversion to 330° F.— | 37.97 | 44.53 | 52.19 |
| Crackability (based on 650° F.$^-$) | 1.14 | 1.44 | 1.89 |

A comparison of the product slate resulting from the cracking of gas oil alone as described in Example 3 and the cracking of gas oil/extract blend described in the present Example reveals the incremental yields indicated below in Table 7C.

TABLE 7C

| Incremental Yields (Wt. %) | | | |
|---|---|---|---|
| $C_1$ | 0.01 | 0.13 | 0.16 |
| $C_2 + C_2=$ | (0.12) | 0.10 | 0.29 |
| $C^3$ | 0.08 | (0.08) | 0.15 |
| $C_3=$ | (0.59) | (0.33) | 0.35 |
| $iC_4$ | 0.17 | (0.06) | 0.16 |
| $nC_4$ | 0.07 | 0.04 | 0.14 |
| $C_4$='s | 0.21 | 0.35 | 0.80 |
| $C_5$–330° F. | (3.24) | (2.57) | (0.06) |
| 330°–420° | 5.979 | 5.530 | 5.002 |
| 420°–650° | 8.56 | 9.97 | 7.84 |
| 650°–850° | 4.90 | 3.81 | 3.34 |
| 850+ | 1.92 | 0.97 | 0.66 |
| % Coke | 2.05 | 1.84 | 1.69 |
| Incremental (Wt. %) Normalized to 100% | | | |
| $C_1$ | 0.05 | 0.65 | 0.80 |
| $C_2 + C_2=$ | (0.60) | 0.50 | 1.45 |
| $C^3$ | 0.40 | (0.40) | 0.75 |
| $C_3=$ | (2.95) | (1.65) | 1.75 |
| $iC_4$ | 0.85 | (0.30) | 0.80 |
| $nC_4$ | 0.35 | 0.20 | 0.70 |
| $C_4$='s | 1.05 | 1.75 | 4.00 |
| $C_5$–330° F. | (16.20) | (12.85) | (0.30) |
| 330°–420° | 29.85 | 27.65 | 25.00 |
| 420°–650° | 42.80 | 49.85 | 39.20 |
| 650°–850° | 24.50 | 19.05 | 16.70 |
| 850+ | 9.60 | 4.85 | 3.30 |
| % Coke | 12.50 | 9.20 | 8.45 |
| Product Selectivities, % (Based on 650° F.$^-$ + Coke) | | | |

TABLE 7C-continued

| | | | |
|---|---|---|---|
| Dry Gas | (0.01) | 1.6 | 2.8 |
| $C_4$— | (1.3) | (0.1) | 12.9 |
| $C_5$ to 330° F. | (25.3) | (18.0) | (0.3) |
| $C_5$ to 420° F. | 21.3 | 20.7 | 31.1 |
| 420 to 650° F. | 62.1 | 65.4 | 45.4 |
| Coke | 16.0 | 12.9 | 10.6 |
| Conversion to 650° F.−, wt. % | 63.95 | 71.50 | 79.50 |

A review of the results reported in Examples 3 and 4, particularly Tables 6 and 7B, reveals that inclusion of the Example 1 extract in the feed to an FCC unit significantly reduces the crackability of a standard FCC feedstock such as the JSGO. In particular the crackability of the JSGO based upon an average of the three test runs reported in Table 6 is about 2.03 whereas the average crackability of the JSGO/extract of Example 4 is about 1.49, a reduction of about 27 relative percent. This suggests that a higher catalyst/oil ratio would be required in order to obtain a conversion level comparable to that of cracking the Joliet sour gas oil alone. The incremental data in Table 7c also show that addition of the extract of Example 1 in the JSGO significantly reduces gasoline production, that is production of the C5-330° F. fraction. As much as 16 units of gasoline are lost in JSGO conversion for every 100 units of Example 1 extract added.

EXAMPLE 5

The Joliet sour gas oil described in Table 2 and the extract produced in Example 2 were blended in a extract:gas oil ratio of about 1:4 on a weight basis. The blend was analyzed and found to have the properties described in Table 8A.

TABLE 8A

| | JSGO Plus Extract of Example 2 |
|---|---|
| Carbon, Wt. % | 87.69 |
| Hydrogen, Wt. % | 12.07 |
| Sulfur, Wt. % | 2.25 |
| Basic Nitrogen, ppm | 283 |
| Density at 70° C., g/cc | 0.8902 |
| CCR By MCRT, Wt. % | .223 |
| H/C Atomic | 1.65 |
| Distillation, Wt. % | |
| IBP,°F. | 453 |
| 5 | 587 |
| 10 | 640 |
| 20 | 696 |
| 30 | 736 |
| 40 | 775 |
| 50 | 811 |
| 60 | 848 |
| 70 | 883 |
| 80 | 918 |
| 90 | 959 |

An analysis of Tables 2, 7A and 8A reveals that the addition of the extract of Example 2 in the JSGO produces a blend having properties which are generally superior to the blend of Example 4 and generally comparable, and in some cases superior, to the properties of the JSGO alone. For example, the basic nitrogen content of the blend of the present Example is lower than that for both the JSGO alone and for the JSGO/extract blend of Example 4. As is will be understood by those skilled in the art, this reduction is desirable since basic nitrogen is a poison to most FCC catalysts.

This blend was then catalytically cracked in the FCC unit described in Example 3 under conditions essentially identical to those described therein. An analysis of the product produced during these test runs is described in Table 8B below. Table 8C describes the incremental yield difference resulting from the test runs of Example 5.

TABLE 8B

| Run No. | 7 | 8 | 9 |
|---|---|---|---|
| Temperature, °C. | 510 | 510 | 510 |
| Cat/Oil | 3.5 | 4.5 | 6.0 |
| WHSV, $HR^{-1}$ | 2.9 | 2.3 | 1.7 |
| CC of Oil Fed | 66.2 | 71.8 | 81.5 |
| Grams of Oil Fed | 58.9 | 63.9 | 71.4 |
| No. of Cycles | 5 | 9 | 11 |
| Mass Balance | 96.6 | 97.6 | 98.0 |
| Product Analysis, Wt. % | | | |
| $C_1$ | 0.44 | 0.64 | 0.93 |
| $C_2 + C_2$= | 2.04 | 2.24 | 3.26 |
| $C_3$ | 1.15 | 1.56 | 2.02 |
| $C_3$= | 4.37 | 5.50 | 7.16 |
| $iC_4$ | 3.00 | 3.56 | 3.76 |
| $nC_4$ | 0.48 | 0.71 | 0.88 |
| $C_4$='s | 2.39 | 3.46 | 3.08 |
| $C_5$–330° F. | 26.61 | 29.81 | 31.96 |
| 330°–420° | 13.98 | 13.12 | 12.32 |
| 420°–650° | 27.84 | 24.14 | 19.70 |
| 650°–850° | 10.82 | 8.14 | 6.85 |
| 850+ | 1.59 | 1.19 | 0.91 |
| % Coke | 5.29 | 5.93 | 7.14 |
| Product Selectivities (Based on 650° F.−) | | | |
| Dry Gas | 2.96 | 3.32 | 4.75 |
| C4— | 16.60 | 20.37 | 23.89 |
| $C_5$ to 330° F. | 31.81 | 34.37 | 36.20 |
| $C_5$ to 420° F. | 48.51 | 49.49 | 50.16 |
| 420 to 650° F. | 28.58 | 23.30 | 17.86 |
| Coke | 6.32 | 6.84 | 8.09 |
| Conversions & Crackability | | | |
| Conversion to 650° F.− | 83.66 | 86.74 | 88.28 |
| Conversion to 420° F.− | 59.75 | 66.53 | 72.51 |
| Conversion to 330° F.− | 45.77 | 53.41 | 60.19 |
| Crackability (based on 650° F.−) | 1.48 | 1.99 | 2.64 |

TABLE 8C

| Run | 10 | 11 | 12 |
|---|---|---|---|
| Incremental Yields (Wt. %) | | | |
| $C_1$ | 0.06 | 0.20 | 0.28 |
| $C_2 + C_2$= | 0.46 | 0.45 | 0.91 |
| $C_3$ | 0.49 | 0.76 | 0.80 |
| $C_3$= | 0.71 | 1.72 | 1.76 |
| $iC_4$ | 1.55 | 1.62 | 1.18 |
| $nC_4$ | 0.28 | 0.35 | 0.47 |
| $C_4$='s | 0.69 | 0.97 | 0.54 |
| $C_5$–330° F. | (0.81) | (0.99) | 1.84 |
| 330°–420° | 4.63 | 4.16 | 4.06 |
| 420°–650° | 6.89 | 5.89 | 3.22 |
| 650°–850° | 1.56 | 0.98 | 1.20 |
| 850+ | 0.49 | 0.37 | 0.33 |
| % Coke | 3.01 | 3.14 | 3.36 |
| Incremental (Wt. %) Normalized to 100% | | | |
| $C_1$ | 0.30 | 1.00 | 1.40 |
| $C_2 + C_2$= | 2.30 | 2.25 | 4.55 |
| $C^3$ | 2.45 | 3.80 | 4.00 |
| $C_3$= | 3.55 | 8.60 | 8.80 |
| $i^3$–$C_{44}$ | 7.75 | 8.10 | 5.90 |
| n–$C_4$ | 1.40 | 1.75 | 2.35 |
| $C_4$='s | 3.45 | 4.85 | 2.70 |
| $C_5$–330° F. | (4.20) | (4.95) | 9.20 |
| 330°–420° | 23.15 | 20.80 | 20.30 |
| 420°–650° | 34.45 | 29.45 | 16.10 |
| 650°–850° | 7.80 | 4.90 | 6.00 |
| 850+ | 2.45 | 1.85 | 1.65 |
| % Coke | 15.05 | 15.70 | 16.90 |
| Product Selectivities, % Based on 650° F.− + Coke | | | |
| Dry Gas | 2.9 | 3.6 | 6.5 |
| $C_4$— | 23.6 | 33.2 | 32.3 |

TABLE 8C-continued

| Run | 10 | 11 | 12 |
|---|---|---|---|
| $C_5$ to 330° F. | (4.5) | (5.42) | 10.0 |
| $C_5$ to 420° F. | 21.3 | 17.36 | 32.0 |
| 420 to 650° F. | 38.3 | 32.20 | 17.4 |
| Coke | 16.8 | 17.20 | 18.3 |
| Conversion to 650° F.−, wt. % | 89.8 | 91.30 | 92.05 |

A review of the results reported in Examples 3, 4 and 5, particularly Tables 6, 7B and 8B reveal that when the extract produced in Example 2 is substituted for the extract of Example 1, the crackability of the blend increases to a value which is substantially equivalent to the JSGO alone, based upon an average of the respective test runs.

The comparison of the results of Examples 4 and 5 reveals that the negative impact on gasoline yields which results from the inclusion of the extract produced in Example 1 in the FCC feedstock is substantially mitigated when the extract of Example 2 is substituted therefore, as is clearly shown from a comparison of Table 7C and 8C. It is also important to note that relatively high conversion catalytic cracking of the extract of Example 5 produces gasoline yields which are superior to the gasoline yields exhibited by the methods of Examples 4 when test results are compared on a constant conversion basis. Moreover, it appears that the rate of change of gasoline yield with respect to conversion continues to be a positive value for conversions above 65 weight percent whereas both the blend of Example 4 and the JSGO alone appear to have negative slopes for conversions of 65 weight percent and greater. Accordingly, it would appear that the gasoline yields produced according to the methods of Example 5 may actually be greater than the gasoline yields associated with fluid catalytic cracking of the JSGO alone at extremely high conversions.

What is claimed is:

1. A process for producing lube oil and gasoline from a lube oil base stock and a standard catalytic cracking feedstock comprising:

(a) hydrocracking said lube oil base stock at moderate severity conditions including a reactor inlet pressure of 400 to 2000 psig, a reactor temperature of 650° to 850° F. and a space velocity of 0.1 to 10 $hr^{-1}$ to produce a hydrocrackate comprising at least about 10 percent by weight aromatic hydrocarbons;

(b) solvent extracting at least a portion of said hydrocrackate to provide a paraffin rich raffinate and an aromatics rich extract, said extract comprising aromatic hydrocarbons in an amount at least about 10 percent of the extract on a solvent free weight basis;

(c) dewaxing said raffinate to produce a lube oil having a viscosity index of at least about 90; and (d) catalytically concurrently cracking said extract and said standard catalytic cracking feedstock under fluidized conditions, the ratio of said standard catalytic cracking feedstock to said extract being greater than about 1:4.

2. The process of claim 1 wherein the ratio of lube oil to lube oil base stock is at least about 1:5 on a volume basis.

3. The process of claim 1 wherein said lube oil base stock is a virgin lube oil base stock.

4. The process of claim 3 wherein said lube oil base stock is selected from a group consisting of deasphalted oil, vacuum gas oil and mixtures of these.

5. The process of claim 4 wherein said standard catalytic cracking feedstock is selected from the group consisting of straight run gas oil, vacuum gas oil, atmospheric distillates, atmospheric residuum, vacuum residuum, cycle oil, and mixtures of these.

6. The process of claim 1 wherein said step of concurrently catalytically cracking comprises cracking said extract and said standard FCC feedstock at a conversion of at least about 60 percent by weight based upon 650° F.

7. The process of claim 1 wherein at least some of those components of the hydrocrackate boiling below about 900° F. are removed from the hydrocrackate prior to the solvent extraction.

8. The process of claim 1 wherein said solvent extraction step comprises contacting at least a portion of said hydrocrackate with a solvent selected from the group consisting of phenol, furfural, ethylene glycol, liquid sulfur dioxide, dimethyl sulfoxide, dimethylformamide, ethyelene glycol, n-methyl pyrrolidone, and mixtures of these.

9. The process of claim 8 wherein said solvent is furfural.

10. The process of claim 8 wherein said lube oil has a viscosity of less than about 200 SUS at 212° F.

* * * * *